United States Patent [19]

Arai et al.

[11] 4,347,630

[45] Sep. 7, 1982

[54] FASTENER FOR HELMET JAW BAND

[76] Inventors: Hirotake Arai; Michio Arai, both of 2-12, Azuma-cho, Oomiya-shi, Saitama-ken, Japan

[21] Appl. No.: 105,658

[22] Filed: Dec. 20, 1979

[30] Foreign Application Priority Data

May 19, 1979 [JP] Japan ..... 54-61773

[51] Int. Cl.[3] ..... A42B 7/00

[52] U.S. Cl. ..... 2/421; 24/197

[58] Field of Search ..... 2/421, 410–420, 2/5, 6; 24/197, 193

[56] References Cited

U.S. PATENT DOCUMENTS 3,407,452 10/1968 Abert et al. ..... 24/197

4,044,400 8/1977 Lewicki et al. ..... 2/421

4,175,304 11/1979 Bentley ..... 24/197

*Primary Examiner*—Peter P. Nerbun

*Attorney, Agent, or Firm*—Birch, Stewart, Kolasch & Birch

[57] ABSTRACT

A fastener for a helmet jaw band comprising first and second rings provided at the end of one of two band sections of the jaw band coupled to the lower end of a helmet, said second ring being positioned on the outer side of said first ring whereby the remaining section of the jaw band is fastened between said first and second rings, wherein an escapement is provided relative to said second ring so that the second ring will not cause the first ring to be urged against the face of a wearer when a pulling force is exerted on both band sections of the jaw band.

1 Claim, 5 Drawing Figures

FASTENER FOR HELMET JAW BAND

BACKGROUND AND SUMMARY OF THE INVENTION

The present invention relates to a fastener for fastening together jaw band sections coupled to the lower end of a helmet, on the opposite sides thereof. More particularly, the present invention is directed to a fastener for a helmet jaw band which does not protrude into the cheek when opposite side jaw band sections of the helmet are fastened together by the fastener.

An example of the prior-art fasteners for helmet jaw bands of this kind is shown in FIG. 5; this fastener comprises two rings 9 and 10 which are both attached to the end of a jaw band section 11. The outer jaw band section 12 is adapted to be passed through the two rings 9 and 10 from the inside to the outside thereof, and then the end portion of the band is adapted to be folded back and passed through the inner ring so that the folded portion is clamped between the upper and lower rings 9 and 10 such that the band sections fastened together cannot be loosened.

However, since the two rings for clamping the folded portions of the band section are both attached to the end of the other band section, by pulling the band portion which has been passed through the rings, for tightening the band, the upper or outer ring, through which the jaw band is passed, urges the lower (or inner) ring against the cheek (a) from the outside to the inside thereof, thus causing pain to the cheek which is felt when the helmet is worn for an extended period of time.

Accordingly, an object of the present invention is to provide a fastener for a helmet jaw band, which overcomes the aforementioned drawbacks inherent in the prior art fasteners of this kind and thus allows a helmet to be worn in a comfortable manner.

Another object of the present invention is to provide a fastener, which has a similar construction to the prior-art fasteners and can be produced in a very simple manner.

A further object of the present invention is to provide a jaw band containing a fastener, which allows for very simple releasing and removing of the fastening band.

Other objects and further scope of applicability of the present invention will become apparent from the detailed description given hereinafter; it should be understood, however, that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The present invention will become more fully understood from the detailed description given hereinbelow and the accompanying drawings which are given by way of illustration only and, thus, are not limitative of the present invention, and wherein.

DETAILED DESCRIPTION OF THE INVENTION

Figure 1:
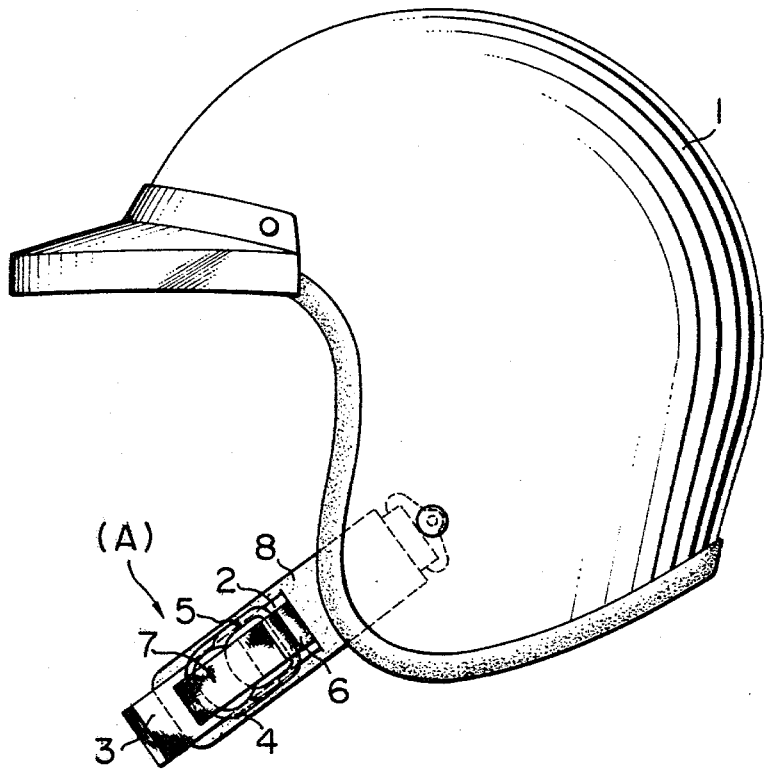
FIG. 1 is a side view of the present invention.

An embodiment of the present invention will now be described with reference to the drawings. FIG. 1 is a side view showing a helmet provided with a jaw band having a fastener according to the present invention. The helmet 1 is made from a fiber-reinforced resin (FRR). The helmet 1 has jaw band sections 2 and 3 of a known construction which are coupled together at their lower, free end portions from opposite directions.

Of the jaw band sections 2 and 3, section 2 is provided at its free end with first and second rings 4 and 5. The other section 3 is adapted to be hooked by the first and second rings 4 and 5 so that the helmet may be steadily secured to the head.

Figure 2:
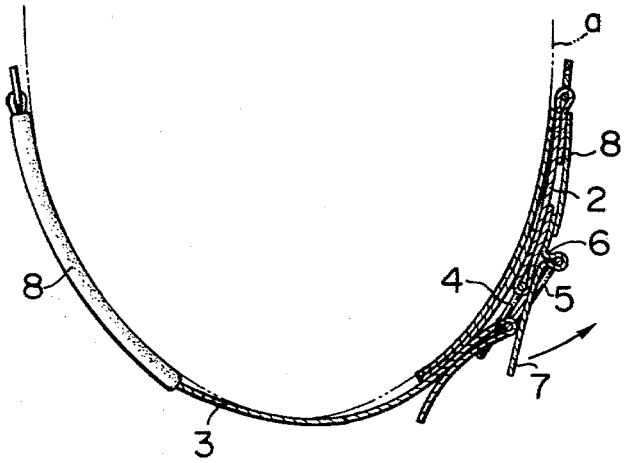
FIG. 2 is a cross-sectional view taken in the direction of arrow A and partly broken away.
Figure 3:
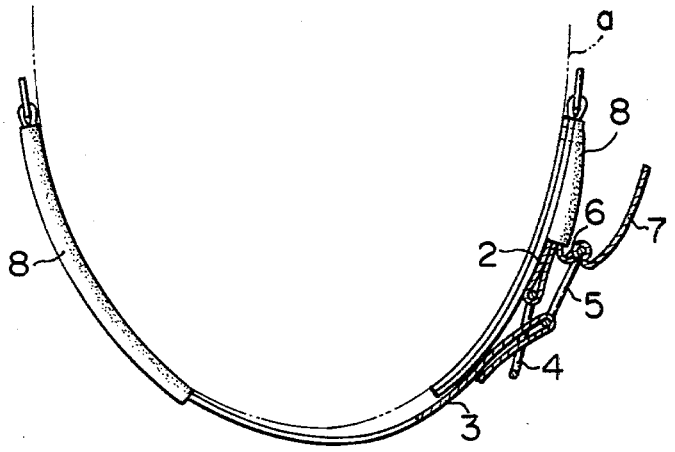
FIG. 3 is a view similar to FIG. 2 but showing a state where the tape cloth is pulled to release the band.
Figure 4:
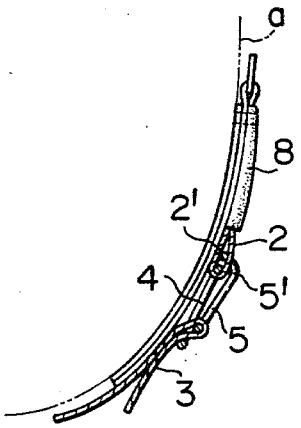
FIG. 4 is a sectional view showing a different embodiment of the present invention.
Figure 5:
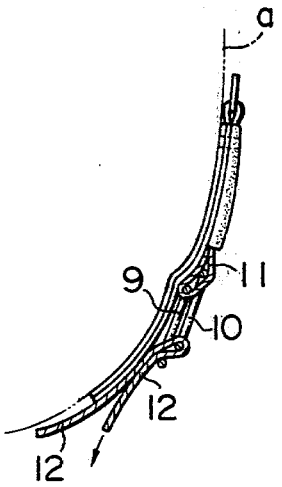
FIG. 5 is a sectional view showing a prior-art structure.

The second ring 5 provided on the jaw band section 2 is positioned on the outer side of the first ring 4, and an escapement is provided for it such that the pulling action of the opposite jaw band sections 2 and 3 will not be hindered. The "escapement" may be provided for the second ring 5 either by attaching the second ring 5 independently of and at a separation position from that of the first ring 4 (see FIGS. 1 to 3) or by bending a rear portion of the second ring 5 such that it has an L-shaped side view 5' as shown in FIG. 4, with the second ring 5 being in this case attached at the same position as the first ring 4.

These two embodiments will now be described in greater detail. In the case of independently attaching the second ring 5, it is attached at a position above the position of the first ring 4 by using a separate tape cloth 6, or the like. The tape cloth 6 carrying the second ring 5 has an end portion serving as a grip portion 7 which can be used for releasing the jaw band sections 2 and 3 fastened together. More particularly, when removing the jaw band section 3 passed through and locked by the first and second rings 4 and 5, the tape cloth 6 carrying the second ring 5 is pulled in the outer and upper directions whereby the second ring 5 is pulled to release the jaw band 3 wound on and engaging the second ring 5 from its clamped state with respect to the first ring 4. In this way the jaw band section 3 can be removed from the second ring 5. The operation is very simple compared from the troublesome prior-art methods of removing a jaw band portion clamped between the first and second rings 4 and 5 which requires one to grip the rings and jaw bands. Thus, an excellent releasing property of the jaw band can be obtained.

In the case of bending the second ring 5 such that it has a substantially L-shaped side view, the second ring 5 is coupled together with the first ring 4 to a loop portion 2' of the jaw band section 2. In this case the bent portion 5' of the second ring 5 is received by the loop portion 2' such that it assumes a position above the first ring 4. With this arrangement, even when the jaw band section 3 having passed through the first and second rings 4 and 5 is pulled to tighten the band, the stem portion of the first ring 4 is not urged by the second ring 5, and thus the portion of the jaw band section 2 carrying the first and second rings 4 and 5 is held flat and never applies pressure against the cheek (a).

In the figures, element 8 is a pad member through which the jaw band section 2 or 3 is passed.

In either of the aforementioned situations, the effect of clamping the jaw band can be enhanced by pressing the first and second round rod rings 4 and 5 into a flat state. Because the fastener according to the present invention has the construction as described in detail hereinabove, it can be used without causing any urging pressure or pain against the cheek. Further, its construction and installation are simple; and also it can be produced simply and inexpensively.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A fastener for coupling a helmet jaw band, said band comprising left and right jaw band sections attached to said helmet at the lower ends thereof in a frontal position, said left band having a free end loop portion and said right band having a free end flat portion, said fastener comprising a first inner ring and a second outer ring, unattached, associated with said left and right jaw band sections, each ring having upper and lower horizontal portions, said upper portion of said second outer ring having a bent L-shaped configuration which projects inwardly over said upper portion of said first inner ring such that, when said upper portions of said first and second rings are secured to said loop portion of said left jaw band, said upper portion of said first inner ring is positioned inside and below said upper bent L-shaped configuration of said second outer ring such that, upon fastenting said free end portion of said right jaw band between said lower portions of said first inner and said second outer rings, said helmet is comfortably secured when worn.

* * * * *